United States Patent [19]

Takagi et al.

[11] Patent Number: 4,619,893

[45] Date of Patent: Oct. 28, 1986

[54] LIGHT-SENSITIVE MATERIAL FOR SILVER SALT DIFFUSION TRANSFER PROCESS WITH ANTIHALATION DYE

[75] Inventors: Yoshihiro Takagi; Keiichi Adachi, both of Kanagawa, Japan

[73] Assignee: Fuji Photo Film Co., Ltd., Kanagawa, Japan

[21] Appl. No.: 700,245

[22] Filed: Feb. 11, 1985

[30] Foreign Application Priority Data

Feb. 16, 1984 [JP] Japan ..... 59-27663

[51] Int. Cl.[4] ..... G03C 1/84; G03C 5/54

[52] U.S. Cl. ..... 430/519; 430/204; 430/227

[58] Field of Search ..... 430/519, 227, 204

[56] References Cited

U.S. PATENT DOCUMENTS 2,622,026 12/1952 Hunter et al. ..... 430/519
4,062,682 12/1977 Laridon et al. ..... 430/204
4,336,323 6/1982 Winslow ..... 430/519

*Primary Examiner*—Richard L. Schilling
*Attorney, Agent, or Firm*—Sughrue, Mion, Zinn, Macpeak, and Seas

[57] ABSTRACT

A light-sensitive material for a silver salt diffusion transfer process is described, having an antihalation layer containing at least one oil-soluble dye represented by following general formula (I)

(I)

wherein X represents a benzene ring, a thiazole ring or a benzothiazole ring each having at least one electron attractive group selected from a nitro group, a cyano group, an alkylsulfonyl group, a halogen atom, and a trifluoromethyl group; $R_1$, $R_2$, $R_3$, $R_4$ each represents hydrogen, a substituted or unsubstituted alkyl group having 1 to 12 carbon atoms, a substituted or unsubstituted alkoxy group having 1 to 12 carbon atoms, a substituted or unsubstituted alkylamido group having 2 to 30 carbon atoms or a substituted or unsubstituted arylamido group having 6 to 30 carbon atoms; any Y and Z each represents hydrogen or a substituted or unsubstituted alkyl group having 1 to 10 carbon atoms.

6 Claims, No Drawings

LIGHT-SENSITIVE MATERIAL FOR SILVER SALT DIFFUSION TRANSFER PROCESS WITH ANTIHALATION DYE

FIELD OF THE INVENTION

This invention relates to a light-sensitive material for use with a silver salt diffusion transfer process. More particularly, the invention relates to a light-sensitive material for a silver salt diffusion transfer process having an improved antihalation layer.

BACKGROUND OF THE INVENTION

The principle of a silver salt diffusion transfer process (hereinafter, referred to as DTR process) is well known as described in, for example, U.S. Pat. No. 2,352,014.

In a DTR process, a silver salt is imagewise transferred from silver halide emulsion layers into an image-receiving layer by diffusion and, in many cases, converted into a silver image in the presence of physical developing nuclei. For this purpose, the silver halide emulsion layer imagewise exposed is disposed in contact with or brought into contact with an image-receiving layer in the presence of a silver halide complexing agent, whereby the unexposed silver halide is converted into a soluble silver complex salt. In the exposed areas of the silver halide emulsion layer, the silver halide is developed (chemical development) into silver and hence silver can no longer dissolve and diffuse. In the unexposed areas of the silver halide emulsion layer, the silver halide is converted into a soluble silver complex salt, which is transferred into the image-receiving layer and usually forms a silver image in the presence of a physical developing nuclei.

In a direct positive silver halide emulsion, the behavior of the silver halide in the exposed areas and the unexposed areas is contrary to the aforesaid case.

The DTR process can be applied in a wide range of fields. Among these fields, in the method of reproducing documents and, in particular, the production of a material for photomechanical process, it is necessary to obtain a silver image having a high density, a high contrast, and a high sharpness in the image-receiving layer. Furthermore, the image reproducing charcteristics, that is, the characteristic of reproducing images from an original as faithful as possible, e.g., reproducing ruled lines having a width of several tens of microns as fine line images as they are is very important. Also, it is particularly important that both the ruled lines of an original having ruled lines (black lines) of a positive image with a white background and ruled lines (white lines) of a negative image with a black background in a disordered state, are faithfully reproduced. In addition, the allowance for the light exposure amount necessary for reproducing these black lines and white lines must be wide (the light exposure latitude is wide), and when a continuous tone original is printed through a contact screen and then a diffusion transfer development is performed, a dot image faithful to the original must be reproduced.

It is well known to form an antihalation layer on a silver halide light-sensitive material (negative working) for obtaining these image reproducing characteristics. When a light-sensitive material is lacking in the antihalation layer, there are defects that fine lines are not reproduced and the exposure latitude is narrowed.

Also, in the case of dot images, gradation becomes hard and the reproduction of fine portions is inadequate.

As a pigment which is used in the antihalation layer for improving the image reproducing characteristics, carbon black is usually used.

On the other hand, a typical processing composition which is used for the DTR process contains a silver halide complexing agent such as a thiosulfate, etc., an alkali agent such as sodium hydroxide, etc., a perservative such as a sulfite, etc., and a developing agent such as hydroquinone, 1-phenyl-3-pyrazolidone, etc.

The high-alkaline processing composition containing the developing agent has a disadvantage in that the developing agent losses its effect due to air oxidation. Accordingly, it is known to avoid the foregoing disadvantage by incorporating the developing agent is a light-sensitive material for a DTR process, that is, in a silver halide emulsion layer and/or a hydrophilic colloid layer which is in a water permeable relation with the emulsion layer.

However, even when the developing agent is incorporated in a silver halide emulsion layer or a light-insensitive layer such as a protective layer, an interlayer, a subbing layer, etc., complete avoidance of air oxidation on the developing agent is impossible. As a result, undesirable defects such as reduction of the developing rate, reduction of sensitivity, reduction of silver image density, formation of fog, etc. occur.

The deterioration of the developing agent is caused not only by air oxidation but also by other factors and it has been confirmed that carbon black is one of these factors. The deterioration of the developing agent occurs with almost all hydroquinones, p-aminophenols, ascorbic acid, dihydroxynaphthalenes, etc., and is particularly severe with 1-phenyl-3-pyradolines.

It is well known that carbon black is useful as a pigment for antihalation but it is known that carbon black causes fog when the silver halide light-sensitive material containing it is stored as described in, for example Japanese Patent Application (OPI) No. 68520/75 (corresponding to U.S. Pat. No. 3,900,323). Therefore, the incorporation of carbon black in a silver halide light-sensitive material causes a serious problem in the storage thereof. Further, the incorporation of carbon black in a silver halide light-sensitive material containing a 1-phenyl-3-pyrazolidone causes a more serious problem in the storage thereof.

It is generally considered that the bad influence of carbon black on the formation of fog and on the storage stability of the silver halide light-sensitive material is caused by impurities contained in carbon black. Accordingly, it has keenly be desired to employ other means than carbon black for antihalation.

Dyes are generally considered as antihalation materials in place of carbon black. Dyes for use as antihalation materials for silver halide light-sensitive materials are required to have the properties that they do not diffuse into adjacent layers, they do not dissolve in processing solutions or water, they are incorporated in silver halide light-sensitive materials in high concentration as antihalation materials, and the dye itself or impurities thereof do not give bad influences on the occurence of fog and the storage stability of the light-sensitive materials. However, dyes meeting these requirements have not yet been found. That is, many dyes have such problems that they cannot be incorporated in silver halide light-sensitive materials to an extent of imparting an antihalation effect to the light-sensitive materials in the case of incorporating them in the light-sensitive material by, for example, an oil dispersion or a dispersion with a surface active agent, due to the inferior dispersibility or inferior dissolution, and they diffuse in the adjacent silver halide emulsion layer to desensitize the emulsion layer during coating the silver halide emulsion layers. Further, they are decolored in the coating solution or dissolve in processing solutions or water for washing. In addition, impurities in the dyes adversely influences the desensitization and the storage stability of the light-sensitive materials.

SUMMARY OF THE INVENTION

An object of this invention is, therefore, to provide an antihalation method for negative working light-sensitive material for a diffusion transfer process (a silver halide light-sensitive material) in place of carbon black.

Another object of this invention is to provide an antihalation method which does not adversely influence the occurence of fog and the storage stability of a light-sensitive material for a diffusion transfer process.

A further object of this invention is to provide an antihalation method wherein an antihalation dye does not diffuse into an adjacent layer at coating and does not decolor in the coating solution thereof in a light-sensitive material for a diffusion transfer process.

Still another object of this invention is to provide an antihalation method wherein an antihalation dye does not dissolve in processing solutions at processing of a light-sensitive material for a diffusion transfer process.

Another object of this invention is to provide an antihalation dye for a light-sensitive material for a diffusion transfer process in place of carbon black.

Still another object of this invention is to provide an antihalation dye for a light-sensitive material for a diffusion transfer process containing 1-phenyl-3-pyrazolidones.

Another object of this invention is to provide a light-sensitive material for a diffusion transfer process containing an antihalation dye which does not adversely influence the occurence of fog and the storage stability of the light-sensitive material.

A further object of this invention is to provide a light-sensitive material for a diffusion transfer process containing an antihalation dye which does not diffuse into an adjacent layer at coating and does not decolor in the coating solution thereof.

Still another object of this invention is to provide a light-sensitive material for a diffusion transfer process containing an antihalation dye which does not dissolve in processing solutions at processing.

It has now been discovered that the above objects of this invention can be attained by the present invention as set forth below. That is, according to this invention, there is provided a light-sensitive material for a silver salt diffusion transfer process having an antihalation layer containing at least one oil-soluble dye represented by following general formula (I)

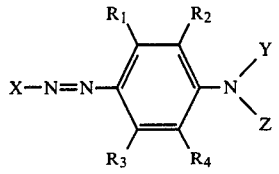

(I)

wherein X represents a benzene ring, a thiazole ring, or a benzothiazole ring each having at least one electron attractive group selected from a nitro group, a cyano group, an alkylsulfonyl group, a halogen atom, and a trifluoromethyl group; $R_1$, $R_2$, $R_3$ and $R_4$ each represents hydrogen, a substituted or unsubstituted alkyl group having 1 to 12 carbon atoms, a substituted or unsubstituted alkoxy group having 1 to 12 carbon atoms, a substituted or unsubstituted alkylamido group having 2 to 30 carbon atoms or a substituted or unsubstituted arylamido group having 6 to 30 carbon atoms; and Y and Z each represents hydrogen or a substituted or unsubstituted alkyl group having 1 to 10 carbon atoms.

DESCRIPTION OF THE PREFERRED EMBODIMENT

In the dye represented by foregoing general formula (I), X is preferably a benzene ring having at least one electron attractive group.

The alkyl group shown by $R_1$, $R_2$, $R_3$ and $R_4$ in general formula (I) preferably has 1 to 4 carbon atoms. The alkoxy group shown by $R_1$, $R_2$, $R_3$ and $R_4$ preferably has 1 to 4 carbon atoms. The alkylamido group shown by $R_1$, $R_2$, $R_3$ and $R_4$ preferably has 2 to 25 carbon atoms. The arylamido group shown by $R_1$, $R_2$, $R_3$ and $R_4$ preferably has 6 to 25 carbon atoms.

It is also preferred that at least one of Y and Z in general formula (I) is a substituted or unsubstituted alkyl group.

It is also preferred that $R_3$ of the compound represented by foregoing general formual (I) is a substituted or unsubstituted alkylamide group, or a substituted or unsubstituted arylamide group.

Preferred examples of substituents for the alkyl group shown by $R_1$, $R_2$, $R_3$, $R_4$, Y and Z in general formula (I) include an alkoxy group and a halogen atom (such as chlorine, bromine or etc.).

Preferred examples of substituents for the alkoxy group shown by $R_1$, $R_2$, $R_3$ and $R_4$ in general formula (I) include an alkoxy group and a halogen atom (such as chlorine, bromine or etc.).

Preferred examples of substituents for the alkylamido group shown by $R_1$, $R_2$, $R_3$ and $R_4$ in general formula (I) include a halogen atom (such as chlorine, bromine or etc.), an alkoxy group, a phenoxy group, an alkoxycarbonyl group and a phenyl group.

Preferred examples of substituents for the arylamido group shown by $R_1$, $R_2$, $R_3$ and $R_4$ in general formula (I) include a halogen atom (such as chlorine, bromine or etc.), an alkoxy group, a phenoxy group, an alkoxycarbonyl group and an alkyl group.

Specific non-limiting examples of the oil-soluble dyes represented by general formula (I) are shown below.

| Dye No. | | |
|---|---|---|
| 1. | 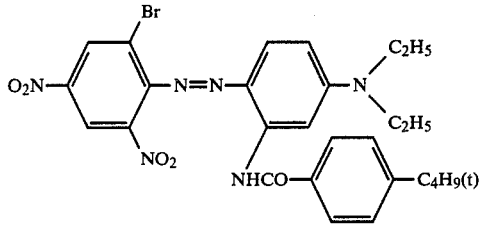 | Purple (Color of ethyl acetate solution) |
| 2. | 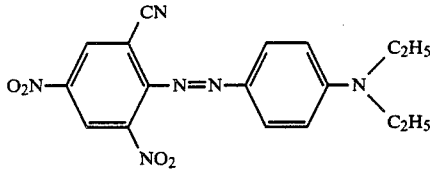 | Blue (Color of ethyl acetate solution) |
| 3. | 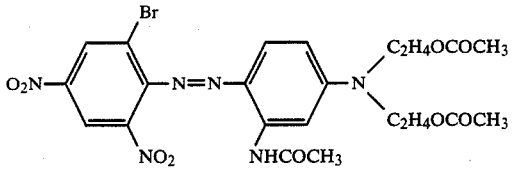 | Purple (Color of ethyl acetate solution) |
| 4. | 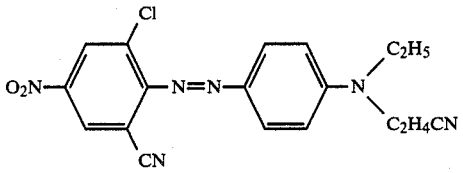 | Red (Color of ethyl acetate solution) |
| 5. | 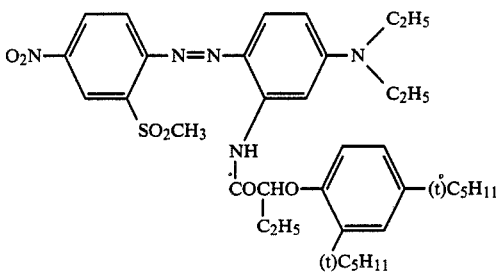 | Purple (Color of ethyl acetate solution) |
| 6. | 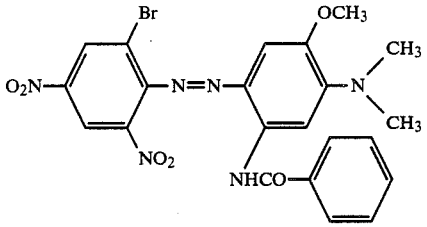 | Blue (Color of ethyl acetate solution) |
| 7. | 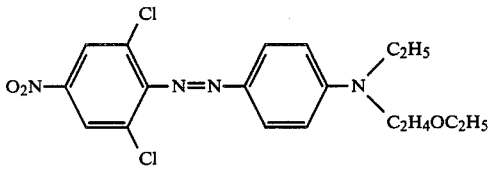 | Yellow (Color of ethyl acetate solution) |

-continued
| Dye No. | | |
|---|---|---|
| 8. | 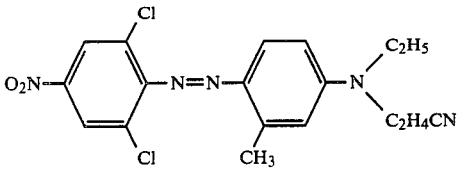 | Yellow (Color of ethyl acetate solution) |
| 9. | 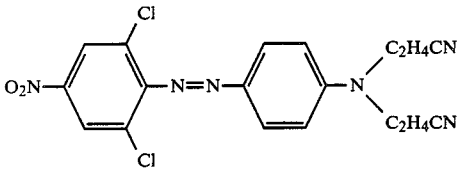 | Yellow (Color of ethyl acetate solution) |
| 10. | 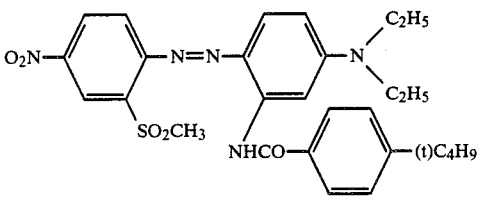 | Purple (Color of ethyl acetate solution) |
| 11. | 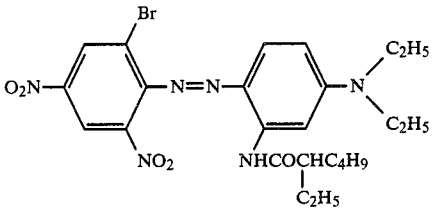 | Purple (Color of ethyl acetate solution) |
| 12. | 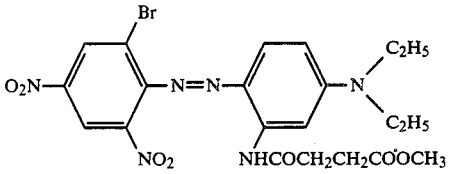 | Purple (Color of ethyl acetate solution) |
| 13. | 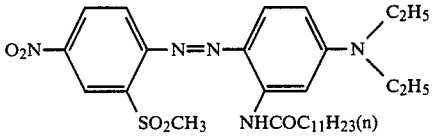 | Purple (Color of ethyl acetate solution) |
| 14. | 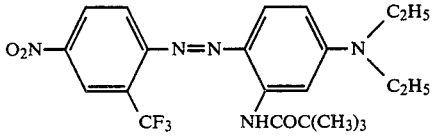 | Purple (Color of ethyl acetate solution) |
| 15. | 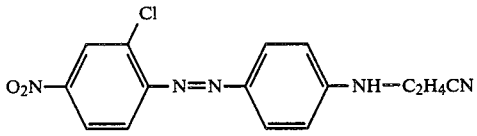 | Orange (Color of ethyl acetate solution) |

-continued

| Dye No. | | |
|---|---|---|
| 16. | 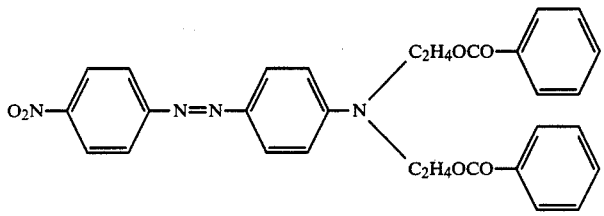 | Yellow (Color of ethyl acetate solution) |
| 17. | 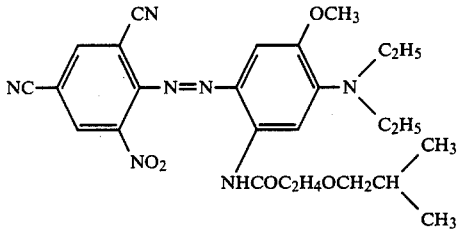 | Blue (Color of ethyl acetate solution) |
| 18. | 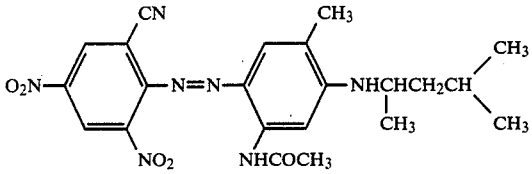 | Blue (Color of ethyl acetate solution) |
| 19. | 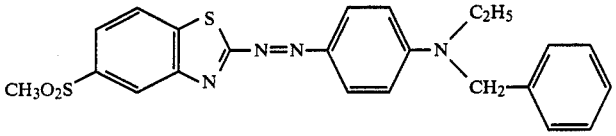 | Orange (Color of ethyl acetate solution) |
| 20. | 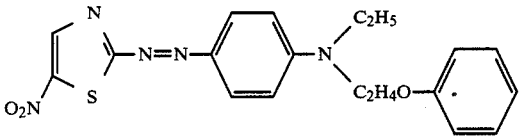 | Purple (Color of ethyl acetate solution) |
| 21. | 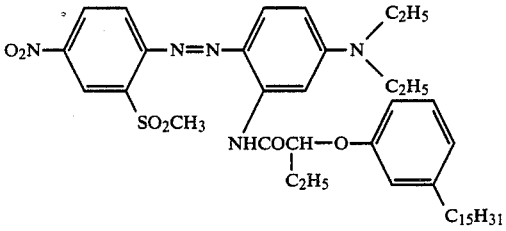 | Purple (Color of ethyl acetate solution) |

The oil-soluble dyes represented by foregoing general formula (I) are described in British Pat. No. 1,479,469 and West German Patent Application (OLS) No. 1,946,459. The oil-soluble dyes other than those described therein also can be easily synthesized according to the preparation methods as described therein.

In a preferred embodiment of the light-sensitive materials for the silver salt diffusion transfer process of this invention, an antihalation layer containing at least one oil-soluble dye represented by general formula (I) is formed on a support and a silver halide light-sensitive emulsion layer or silver halide light-sensitive emulsion layers are formed on the antihalation layer.

In another preferred embodiment of light-sensitive materials for the silver salt diffusion transfer process of this invention, an antihalation layer containing the foregoing oil-soluble dye and a developing agent is formed on a support and silver halide light-sensitive emulsion layer or layers are formed thereon.

In still another preferred embodiment of this invention, an antihalation layer containing the oil-soluble dye described above and silver halide light-sensitive emulsion layer or layers containing a developing agent are formed on the antihalation layer.

In another preferred embodiment of this invention, an antihalation layer containing both the oil-soluble dye described above and a developing agent and silver halide light-sensitive emulsion layer or layers containing a developing agent are formed on the antihalation layer.

The compound represented by general formula (I) for use in this invention is oil-soluble and is insoluble in water or aqueous solutions. Accordingly, for introducing the compound into silver halide light-sensitive materials, a method usually used for dispersing couplers in the case of producing color light-sensitive materials can be used. Practically, an oil dispersion method or a latex dispersion method is used. The oil for use in the oil dispersion method includes alkyl phosphates such as tri-n-butyl phosphate, tri-n-pentyl phosphate, tri-n-hexyl phosphate, dibutyloctyl phosphate, trioctyl phosphate, trinonyl phosphate, etc.; triacryl phosphates such as tricresyl phosphate, dimethylbenzene phosphate, etc.; dialkyl phthalates such as dimethyl phthalate, diethyl phthalate, dipropyl phthalate, dibutyl phthalate, dipentyl phthalate, diheptyl phthalate, dioctyl phthalate, etc. Preferred oils depend upon the kind of the oil-soluble dyes to be used, but they include generally tricresyl phosphate, dimethylbenzene phosphate, dibutyl phthalate, dimethyl phthalate, dipentyl phthalate, etc.

At least one of the oil-soluble dyes represented by general formula (I) is dissolved in the foregoing oil and the solution is emulsified in an aqueous gelatin solution using a surface active agent such as sodium alkylbenzenesulfonate and sodium alkylsulfonate. The compound of this invention represented by general formula (I) can be used in the range of 0.05 g to 1.0 g per square meter, preferably 0.08 to 0.8 g per square meter.

In an example of the negative working light-sensitive material for the diffusion transfer process of this invention, an antihalation layer containing at least one compound represented by general formula (I) is formed on a support and a silver halide emulsion layer or silver halide emulsion layers are formed on the antihalation layer.

In the case of incorporating a developing agent in a light-sensitive material, the developing agent may be incorporated in the antihalation layer containing the compound of general formula (I) or may be incorporated in a silver halide emulsion layer.

Examples of the developing agent for use in this invention include hydroquinones such as hydroquinone, t-butylhydroquinone, methylhydroquinone, etc.; 3-pyrazolidinones such as 1-phenyl-3-pyrazolidinone, 4,4-dimethyl-1-phenyl-3-pyrazolidinone, 4-hydroxymethyl-4-methyl-1-phenyl-3-phyrazolidinone, 4,4-dimethyl-1-p-tolyl-3-pyrazolidinone, 4-hydroxymethyl-4-methyl-1-p-tolyl-3-pyrazolidinone, 1-p-tolyl-3-pyrazolidinone, 5,5-dimethyl-1-phenyl-3-pyrazolidione, 4-methyl-1,5-diphenyl-3-pyrazolidinone, 5-methyl-1,5-diphenyl-3-pyrazolidinone, 4-methyl-1-phenyl-3-pyrazolidone, 5-methyl-1-phenyl-3-pyrazolidone, 4,4-dihydroxymethyl-1-phenyl-3-pyrazolidone, 4,4-dihydroxymethyl-1-p-tolyl-3-pyrazolidone, 1,4-diphenyl-3-pyrazolidone, 1,5-diphenyl-3-pyrazolidone, 4-methyl-4-hydroxymethyl-1-phenyl-3-pyrazolidone, 4-hydroxymethyl-1-phenyl-3-pyrazolidone, 1-o-tolyl-pyrazolidone, 1-m-tolyl-3-pyrazolidone, 1-p-tolyl-3-pyrazolidone, 4,5-dimethyl-1-phenyl-3-pyrazolidone, 1-p-hydroxyethylphenyl-3-pyrazolidone, 1,4-dimethyl-3-pyrazolidone, etc.

In this invention, a compound selected from hydroquinones and 3-pyrazolidinones can be used but it is preferred to use a hydroquinone and a 3-pyrazolidinone together. For example, a combination of hydroquinone and 4-hydroxymethyl-4-methyl-1-p-tolyl-3-pyrazolidinone, hydroquinone and 4-hydroxymethyl-4-methyl-1-phenyl-3-pyrazolidinone, hydroquinone and 4,4-dihydroxymethyl-1-phenyl-3-pyrazolidinone, or hydroquinone and 4,4-dihydroxymethyl-1-p-tolyl-3-pyrazolidinone can be used.

The content of a hydroquinone in the light-sensitive material is about 0.06 to about 6.3 moles, preferably about 0.1 mole to about 1.5 moles per mole of silver. Similarly, the content of a pyrazolidione is about 0.006 mole to about 0.6 mole, preferably about 0.02 mole to about 0.16 mole per mole of silver.

The silver halide for use in this invention is silver chloride, silver chlorobromide, silver bromide, silver iodobromide, or silver iodochlorobromide.

The silver halide composition of the silver halide emulsion for use in this invention is preferably silver chlorobromide or silver chlorobromoiodide for obtaining images having a good sharpness and a good contrast, wherein the content of the bromide is about 0.1 mole to about 9 moles, preferably about 0.5 mole to about 5 moles, the content of the iodide is 0 to about 0.2 mole, preferably 0 to 0.1 mole, with the remainder being chloride.

The ratio of a hydrophilic colloid to the silver halide (shown by the value calculated as silver nitrate) in the silver halide emulsion is about 0.1 to about 3.0, preferably about 0.3 to about 2.5, more preferably about 0.5 to about 2.3.

There is no particular restriction about the grain size of the silver halide for use in this invention but the grain size is usually 0.1$\mu$ to 3.0$\mu$, preferably 0.1$\mu$ to 0.5$\mu$.

The silver halide emulsion for use in this invention may contain a slight amount of a noble metal such as Rh, Pd, Ir, Pb, Ni, Cu, Zn, Au, etc. Also, the silver halide emulsion may be sensizited by a sulfur sensitization, a gold sensitization or a combination thereof.

The silver halide emulsion for use in this invention is usually spectrally sensitized on the range of about 530 to about 560 nm but may be panchromatically sensitized.

The silver halide photographic emulsion for use in this invention may be further spectrally sensitized to relatively long wave length blue light, green light, red light, or infrared light. Examples of the sensitizing dye include cyanine dyes, merocyanine dyes, complex cyanine dyes, complex merocyanine dyes, holopolar cyanine dyes, styryl dyes, hemicyanine dyes, oxonole dyes, hemioxonole dyes, etc. They may be used solely or as a combination thereof.

The silver halide emulsion layers and/or the image-receiving layer may contain any desired compounds which are ordinary used for practicing a silver salt diffusion transfer process. These compounds include coating aids such as saponin, polyalkylene oxides, etc.; hardening agents such as formalin, chromium alum, etc.; plasticizers, etc. The coating aids are preferably used in a coverage of 0.0001 to 0.3 g/m$^2$, the hardening agents are preferably used in a coverage of 0.01 to 1 g/m$^2$, and the plasticizers are preferably used in a coverage of 0.1 to 10 g/m$^2$.

As the support having the silver halide light-sensitive emulsion layers or the image-receiving layer or both the silver halide emulsion layers and the image-receiving layer, a support usually used for light-sensitive materials can be used. That is, there are papers, glass plates, films such as cellulose acetate films, polyvinyl acetal films, polystyrene films, polyethylene terephthalate films, etc., metal foils coated with papers at both sides thereof, paper supports coated with a polymer of an $\alpha$-olefin such as polyethylene at one surface or both surfaces thereof.

The image-receiving layers for use in this invention always contain physical developing nuclei and usually further contains a hydrophilic colloid material as well as a whitening agent such as brightening agent, an antistaining agent such as boric acid, a surface active agent for coating, a hardening agent, etc., in addition to the physicial developing nuclei. The whitening agents are preferably used in a coverage of 0.01 to 1g/m$^2$, the surface active agents for coating are preferably used in a coverage of 0.0001 to 0.3 g/m$^2$ and the hardening agents are preferably used in a coverage of 0.01 to 1 g/m$^2$.

As the physical developing nuclei, conventionally known physical developing nucleus substances such as a heavy metal such as zinc, mercury, lead, cadmium, iron, chromium, nickel, tin, cobalt, copper, etc.; a noble metal such as palladium, platinum, silver, gold, etc.; or the sulfides, selenides, tellurides, etc., of these metals can be used. These physical developing nucleus substances can be prepared by reducing a corresponding metal ion to form a metal colloid dispersion or by mixing a metal ion solution with a solution of a soluble sulfide, selenide, or telluride to provide a colloid dispersion of a water-insoluble metal sulfide, metal selenide, or metal telluride.

The behavior of the physical developing nucleus substance in a silver salt diffusion transfer process is described in, for example, Edwin H. Land et al, U.S. Pat. No. 2,774,667 issued Dec. 18, 1956. For obtaining an image-receiving element capable of giving images having a high contrast, the image-receiving layer contains the physical developing nuclei in a proportion of $10^{-6}$ to $10^{-1}$ g/m$^2$, preferably $10^{-5}$ to $10^{-2}$ g/m$^2$.

A light-sensitive material for a silver salt diffusion transfer process is composed of a support and at least one silver halide emulsion layer formed thereon and silver halide is coated in a coverage of 0.5 to 3.5 g/m$^2$ calculated as silver nitrate. If necessary, auxiliary layers such as a subbing layer, an interlayer, a protective layer, a stripping off layer, etc., are formed in addition to the silver halide emulsion layer. For example, the light-sensitive material of this invention can have a layer of a water-permeable binder such as a sodium salt of methyl cellulose, carboxymethyl cellulose, etc., sodium algiante, etc., as a coating layer for the silver halide emulsion layer for improving the uniformity of the transfer of images as described in Japanese Patent Publication Nos. 18134/63 and 18135/63. The coating layer is as thin as possible for substantially not perventing or inhibiting the diffusion of images. The coating layer preferably has a thickness of about 3$\mu$ or less.

The silver halide emulsion layers of the light-sensitive material and the image-receiving layer of the image-receiving material contain at least one of hydrophillic colloid substances, for example, gelatin, a gelatin derivative such as phthalated gelatin, etc., a cellulose derivative such as carboxymethyl cellulose, hydroxymethyl cellulose, etc., dextrin, soluble strach, a hydrophilic synthetic polymer colloid substance such as polyvinyl alcohol, polystyrene sulfonate, etc.

The processing composition for processing the light-sensitive materials for the silver salt diffusion transfer process of this invention may contain an alkaline substance such as sodium hydroxide, potassium hydroxide, lithium hydroxide, sodium tertiary phosphate, etc.; a preservative such as sodium sulfite, etc.; a tackifier such as carboxymethyl cellulose, hydroxyethyl cellulose, etc.; an antifoggant such as potassium bromide, etc.; a silver halide complexing agent such as sodium thiosulfate, etc.; a color toning agent such as 1-phenyl-5-mercaptotetrazole, etc.; a surface active agent such as polyoxyalkylene compound, alkylbenzenesulfonic acid, an onium compound, etc.; a developing nucleus such as those described in British Pat. No. 1,001,558; and, if necessary the above-described developing agent. The pH of the processing solution is for activating the development, is usually 9.5 to 14, preferably about 10 to 13.0. The optimum pH of a processing composition for a light-sensitive material for a silver salt diffusion transfer process depends upon the kind of the light-sensitive material to be processed, the kind of desired images, and the kind and amount of various compounds which are used for the processing composition.

The effects of this invention are particularly remarkable in light-sensitive materials for silver salt diffusion transfer process. In the case of diffusion transfer process, the processing solution contains a silver halide solvent such as sodium thiosulfate and the development of the exposed areas must be finished before sufficiently proceeding the action of the solvent. Accordingly, for increasing the development rate, the pH of the developing solution is higher than 11.0 or a developing agent is incorporated in a light-sensitive material and the light-sensitive material is processed by an activator having a pH of higher than 11.0. In other words, the development is performed at a strong alkalinity. Hence, a light-sensitive material for diffusion transfer process using carbon black is easily influenced by the occurence of fog and the dterioration during storage as compared to a light-sensitive material for conventional processing. Thus, the effect of the oil-soluble dyes in this invention is very remarkable for light-sensitive materials for silver salt diffusion transfer process.

Furthermore, a light-sensitive material for a diffusion transfer process is frequently processed by a processor having no temperature controlling faculty and is usually processed at about 20° C. but is sometimes processed at about 30° C. In such a case, the use of the oil-soluble dyes in this invention is more advantageous as compared with carbon black which is liable to cause fog, etc., in such a high temperature processing.

Furthermore, the antihalation dye for use in this invention does not substantially dissolve in processing solutions or water. Therefore, the dye does not stain the processing solution and the image-receiving layer.

The following non-limiting examples will serve to illustrate the present invention.

EXAMPLE

On one surface of a paper support of 110 g/m$^2$, both the surfaces of which were coated with polyethylene, was formed a gelation layer (4.0 g/m$^2$ of gelatin) containing an emulsion of the antihalation dye as shown in Table 1, or carbon black for antihalation, 0.8 g/m$^2$ of hydroquinone, and 0.2 g/m$^2$ of 4-hydroxymethyl-4-methyl-1-phenyl-3-pyrozolidinone. Then an orthochromatically sensitized gelatino silver chlorobromide emulsion layer containing silver chlorobromide (2 mole % silver bromide) having a mean grain size of 0.3$\mu$ calculated as silver nitrate was formed on the gelatin layer. Thus, four kinds of light-sensitive materials A, B, C, and D were prepared.

On the other hand, an image-receiving layer composed of gelatin and carboxymethyl cellulose (4:1) containing a metal palladium nuclei was formed on a paper support of the same kind as that used for the above light-sensitive materials at a dry weight of the hydrophilic colloid of 3 g/m$^2$ to provide an image-receiving material.

Preparation of dye emulsion

A solution of 6.7 g of Dye No. 5 illustrated above as the oil-soluble dye in this invention dissolved in 100 ml of cresyl phosphate and 100 ml of ehtyl acetate was mixed with 800 ml of an aqueous 12% solution containing 7 g of dodecylbenzenesulfonic acid as solid at about 60° C. and an emulsified dispersion was prepared therefrom using a homogenizer to provide Emulsion (a). Also, by following the same procedure as above using Dye No. 1 and Dye No. 21 illustrated above in place of Dye No. 5, Emulsion (b) and Emulsion (c) were prepared. These emulsions were used for preparing the above-described light-sensitive materials.

For investigating the storage stability of the light-sensitive materials, the 4 kinds of the light-sensitive materials described above were subjected to a forcible storage test of 50° C. and 75% RH for 3 days and then the transfer density of the light-sensitive materials was measured and compared to that of the light-sensitive materials before the forcible storage test.

That is, each of the light-sensitive materials which were not subjected to the above-described forcible storage test and the light-sensitive materials which were subjected to the test was exposed through a continuous tone wedge for sensitometery. The silver halide emulsion layer of the light-sensitive material was brought into contact with the above-described image-receiving material, and were passed through a processing liquid for a silver salt diffusion transfer process (liquid temperature of 23° C.) having the following composition. After passing them through squeeze rollers and drying, the transmission density ($D_{max}$ of the transferred image removing the support) of each sample was measured.

Processing composition for diffusion transfer process:

Water: 800 ml $Na_3PO_4.12H_2O$: 75 g $Na_2SO_3$: 40 g

KBr: 0.5 g $Na_2S_2O_3$: 20 g

1-Phenyl-5-mercaptotetrazole: 70 mg

N-Methylaminoethanol: 10 g

Water to make: 1 liter

The results thus obtained are shown in Table 1.

TABLE 1

| Sample | Dye of the Invention No. | Dye of the Invention Emulsion | Coated Amount of Dye (g/m$^2$) | Transfer Density Before forcible test | Transfer Density After forcible test | Remarks |
|---|---|---|---|---|---|---|
| A | 5 | (a) | 0.18 | 3.10 | 3.00 | Present Invention |
| B | 1 | (b) | 0.19 | 3.12 | 2.98 | Present Invention |
| C | 21 | (c) | 0.20 | 3.0 | 2.97 | Present Invention |

TABLE 1-continued

| Sample | Dye of the Invention No. | Dye of the Invention Emulsion | Coated Amount of Dye (g/m$^2$) | Transfer Density Before forcible test | Transfer Density After forcible test | Remarks |
|---|---|---|---|---|---|---|
| C | Carbon Black (Comparison Example) | | 0.2 | 2.80 | 2.20 | Comparison |

As is clear from the above results, it can seen that by using the oil-soluble dyes in this invention, a high transfer density and excellent storage stability of light-sensitive material can be obtained as compared to the case of using carbon black.

While the invention has been described in detail and with reference to specific embodiments thereof, it will be apparent to one skilled in the art that various changes and modifications can be made therein without departing from the spirit and scope thereof.

What is claimed is:

1. A light-sensitive material for a silver salt diffusion transfer process comprising a silver halide emulsion layer and having an antihalation layer containing a developing agent and at least one oil-soluble dye represented by following general formula (I)

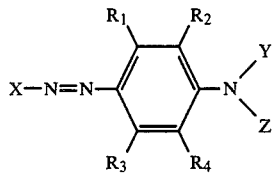

(I)

wherein X represents a benzene ring, a thiazole ring or a benzothiazole ring each having at least one electron attractive group selected from a nitro group, a cyano group, an alkylsulfonyl group, a halogen atom, and a trifluoromethyl group; $R_1$, $R_2$, $R_3$, $R_4$ each represents hydrogen, a substituted or unsubstituted alkyl group having 1 to 12 carbon atoms, a substituted or unsubstituted alkoxy group having 1 to 12 carbon atoms, a substituted or unsubstituted alkylamido group having 2 to 30 carbon atoms or a substituted or unsubstituted arylamido group having 6 to 30 carbon atoms; and Y and Z each represents hydrogen or a substituted or unsubstituted alkyl group having 1 to 10 carbon atoms.

2. The light-sensitive material as claimed in claim 1, wherein X represents a benzene ring.

3. The light-sensitive material as claimed in claim 1, wherein Y and Z represent a substituted or unsubstituted alkyl group.

4. The light-sensitive material as claimed in claim 1, wherein said oil-soluble dye is employed in an amount of from 0.5 grams to 1.0 grams per square meter.

5. The light-sensitive material as claimed in claim 1, wherein said antihalation layer is formed on a support and at least one silver halide light-sensitive emulsion layer is formed on the antihalation layer.

6. The light-sensitive material as claimed in claim 5, wherein said at least one silver halide emulsion layer contains a developing agent.

* * * * *